US007637384B2

(12) United States Patent
Price et al.

(10) Patent No.: US 7,637,384 B2
(45) Date of Patent: Dec. 29, 2009

(54) TAMPER EVIDENT CLOSURE WITH LOCKING BAND AND CONTAINER THEREFOR

(75) Inventors: Michael L. Price, Sandston, VA (US); Thomas M. Seidita, Mechanicsville, VA (US); Udo Boesl, Eilmeldingen (DE); Patrick Habersaat, Reinach (CH)

(73) Assignee: Crown Packaging Technology, Inc., Alsip, IL (US)

( * ) Notice: Subject to any disclaimer, the term of this patent is extended or adjusted under 35 U.S.C. 154(b) by 406 days.

(21) Appl. No.: 10/957,924

(22) Filed: Oct. 4, 2004

(65) Prior Publication Data

US 2005/0072751 A1 Apr. 7, 2005

Related U.S. Application Data

(63) Continuation-in-part of application No. 10/771,614, filed on Feb. 4, 2004, which is a continuation-in-part of application No. 10/241,416, filed on Sep. 11, 2002, application No. 10/957,924, which is a continuation-in-part of application No. 10/486,658, filed as application No. PCT/EP02/08948 on Aug. 9, 2002.

(51) Int. Cl.
*B65D 39/00* (2006.01)

(52) U.S. Cl. ..... 215/253; 215/252; 215/330; 215/44

(58) Field of Classification Search ..... 215/252, 215/44, 253, 330; 220/DIG. 34
See application file for complete search history.

(56) References Cited

U.S. PATENT DOCUMENTS 928,872 A 7/1909 Lyon
D48,033 S 10/1915 Kaye
1,170,160 A 2/1916 Ingram et al.
1,722,587 A 7/1929 McDonnell
3,199,702 A 8/1965 Fischbach
4,326,639 A 4/1982 Stahl et al.
4,402,415 A 9/1983 Hopely (Continued)

FOREIGN PATENT DOCUMENTS

CN 1271681 11/2000

(Continued)

*Primary Examiner*—Anthony Stashick
*Assistant Examiner*—Christopher B McKinley
(74) *Attorney, Agent, or Firm*—Knoble Yoshida & Dunleavy, LLC

(57) ABSTRACT

A container assembly includes a container that has an externally threaded finish portion as well as retention structure for preventing upward movement of a tamper evident band. The container assembly further includes a closure having a body portion of a base and an internally threaded downwardly depending sidewall portion that is sized and shaped to screw onto the finish portion of the container. The closure further includes a tamper evident band that is frangibly connected to the sidewall portion and that includes a main band portion and a J-hook retention member. The J-hook retention member includes a plurality of pleated retaining flaps, each of which has upper portion for engaging the retention structure. Advantageously, at least one of the pleated retaining flaps is further constructed and arranged to engage the container so as to resist rotation with respect to the container, whereby separation of said tamper evident band from said body portion is better assured when the closure is unscrewed from the container.

34 Claims, 8 Drawing Sheets

U.S. PATENT DOCUMENTS

| | | | | |
|---|---|---|---|---|
| 4,550,844 | A | 11/1985 | Lininger | |
| 4,598,835 | A | 7/1986 | Brownbill | |
| 4,638,917 | A | 1/1987 | Persch | |
| 4,657,153 | A | 4/1987 | Hayes | |
| 4,739,893 | A | 4/1988 | Zumbuhl | |
| 4,971,213 | A | 11/1990 | Ishinabe et al. | |
| 4,997,097 | A * | 3/1991 | Krautkramer | 215/307 |
| 5,040,692 | A | 8/1991 | Julian | |
| 5,050,753 | A | 9/1991 | Trump et al. | |
| 5,056,675 | A | 10/1991 | Julian | |
| 5,090,581 | A | 2/1992 | Rose et al. | |
| 5,090,788 | A | 2/1992 | Ingram et al. | |
| 5,197,621 | A | 3/1993 | Bartl et al. | |
| 5,263,600 | A | 11/1993 | Henning | |
| 5,314,085 | A | 5/1994 | Collado Bonet | |
| 5,356,019 | A | 10/1994 | Kelly | |
| 5,400,913 | A | 3/1995 | Kelly | |
| 5,415,306 | A | 5/1995 | Luch et al. | |
| 5,533,633 | A | 7/1996 | King | |
| 5,715,959 | A | 2/1998 | Pfefferkorn et al. | |
| 5,749,201 | A | 5/1998 | Cochrane | |
| 5,749,484 | A | 5/1998 | Trout | |
| 5,782,369 | A | 7/1998 | Tansey | |
| 5,860,542 | A | 1/1999 | Takamatsu | |
| 5,884,790 | A | 3/1999 | Seidita | |
| 5,913,437 | A | 6/1999 | Ma | |
| 5,915,579 | A | 6/1999 | Przytulla et al. | |
| 5,964,139 | A | 10/1999 | Spatz et al. | |
| 6,006,930 | A | 12/1999 | Dreyer et al. | |
| 6,112,923 | A * | 9/2000 | Ma | 215/252 |
| 6,116,443 | A | 9/2000 | Parrinello | |
| 6,464,093 | B1 * | 10/2002 | Takano | 215/252 |
| 6,484,896 | B2 | 11/2002 | Ma | |
| D470,413 | S | 2/2003 | Seidita | |
| 6,557,714 | B2 | 5/2003 | Babcock et al. | |
| 2001/0002661 | A1 | 6/2001 | Reidenbach | |
| 2002/0033374 | A1 | 3/2002 | Ma | |
| 2003/0160020 | A1 * | 8/2003 | Oh | 215/330 |

FOREIGN PATENT DOCUMENTS

| | | |
|---|---|---|
| DE | 8811108 | 2/1989 |
| DE | 8815335 | 2/1989 |
| EP | 0072924 | 5/1989 |
| EP | 0410059 | 6/1994 |
| EP | 0593396 | 1/1996 |
| EP | 0511502 | 4/1996 |
| FR | 2580593 | 4/1985 |
| GB | 2 068 912 | 10/1980 |
| GB | 2 125 382 | 7/1983 |
| JP | 7291318 | 11/1995 |
| JP | 08058817 | 3/1996 |
| JP | 08164960 | 6/1996 |
| WO | WO 91/11369 | 8/1991 |
| WO | WO 01/51375 | 7/2001 |
| WO | WO 03/016161 | 2/2003 |

* cited by examiner

TAMPER EVIDENT CLOSURE WITH LOCKING BAND AND CONTAINER THEREFOR

This is a continuation-in-part of Ser. No. 10/771,614, filed Feb. 4, 2004, which is a continuation-in-part of Ser. No. 10/241,416, filed Sep. 11, 2002. This is also a continuation-in-part of Ser. No. 10/486,658, filed Aug. 11, 2004, arising from PCT/EP02/08948 filed Aug. 9, 2002 from which §120 priority is claimed. The entire disclosure of each of the foregoing documents is hereby incorporated by reference as if set forth fully herein.

BACKGROUND OF THE INVENTION

1. Field of the Invention

This invention relates generally to the field of packaging technology, and more specifically to tamper evident closures for containers.

2. Description of the Related Technology

Various beverages, foods, medicines and the like are delivered to the public in bottles or other containers that are provided with resealable closures. Such closures provide a benefit to the consumer in that the containers can be tightly sealed and resealed after opening, which prolongs the shelf life of the product and maintains freshness. Although resealable containers provide benefits to consumers, by their nature they permit unauthorized and sometimes undetectable tampering with the product. Accordingly, many modem consumer products are packaged using tamper evident closures, which are designed to make it apparent to a consumer that a container has been opened.

Many conventional tamper evident closures utilize what is commonly known as a tamper evident band, which is designed to be retained by the container and to rupture or become separated from the consumer removable portion of the closure during opening. Typically, the container itself will include an annular ring or other retention structure for engaging the tamper evident band. The tamper evident band and the mating retention structure of the container are usually designed so that the tamper evident band will slip over the retention structure without damage during the initial application of the closure onto the container at the packaging plant, but that subsequent removal of the tamper evident band from the container will be difficult.

One type of tamper evident band that is in commercial use includes a first portion that is frangibly connected to the consumer removable portion of the closure and a second retention portion, commonly known as a J-hook, that is molded so as to angle radially inwardly and upwardly from a lower portion of the tamper evident band in order to engage retention structure on the container. During initial application of the closure, the retention portion will slip over the retention structure because of the inward and upward angling, but once it slips over the retention structure it will lock against the lower side of the retention structure, making it difficult to remove the tamper evident band from the container. An example of such a closure is disclosed in U.S. Pat. No. 5,400,913 to Kelly. Such closures are valued for their strength and ease of application.

Unfortunately, because of the inherent elasticity of some types of plastic materials, particularly at elevated temperatures, it is possible in some instances for a closure to be removed from the container with the tamper evident band still joined to the closure. Although, it is to be emphasized, this is a relatively rare occurrence, it is to be taken seriously as it frustrates the fundamental purpose of a tamper evident closure.

Other types of closures have been developed that ensure separation of the tamper evident band from the closure during opening by arresting rotational movement of the tamper evident band with respect to the closure during opening. One example of this would be U.S. Pat. No. 5,040,692 to Julian, which discloses a tamper indicating closure in which ratchet teeth are molded into the tamper evident band. These teeth engage similar projections that are molded beneath the finish portion of a container to which the closure is applied. While closures of this type are no doubt effective, they require the molding of a relatively thick tamper evident band, which increases material costs. Accordingly, for some applications that are more sensitive to material costs it would be economically difficult to apply such technology. Moreover, it is not possible to apply structure of the type that is taught in Julian for use in a closure that utilizes a J-hook type retention structure for the tamper evident band.

A need exists for an improved J-hook type retention structure for a tamper evident band that reduces the likelihood of the closure being unscrewed from a container without separation of the tamper evident band from the rest of the closure.

SUMMARY OF THE INVENTION

Accordingly, it is an object of the invention to provide an improved J-hook type retention structure for a tamper evident band that reduces the likelihood of the closure being unscrewed from a container without separation of the tamper evident band from the rest of the closure.

In order to achieve the above and other objects of the invention, a tamper evident closure according to a first aspect of the invention includes a body portion comprising a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the retaining flaps together extend for an aggregate flap circumferential distance about the hoop-like structure that is within a range of about 40 percent to about 85 percent of a total circumference of the hoop-like structure; and wherein each of the retaining flaps has an upper portion that is constructed and arranged to engage retention structure of a container in order to prevent upward movement of said tamper evident band with respect to the container, and wherein at least one of the retaining flaps is further constructed and arranged to engage the container so as to resist rotation with respect to the container, whereby separation of said tamper evident band from said body portion is assured when the closure is unscrewed from the container.

A tamper evident closure according to a second aspect of the invention includes a body portion comprising a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the connector elements have a first maximum height and said retaining flaps have a second maximum height, and wherein the first height is within a range of about 50 percent to about 95 percent of the second height; and wherein each of the retaining flaps has an upper portion that is constructed and arranged to engage retention structure of a container in order to prevent upward movement of the tamper evident band with respect to the container, and wherein at least one of the retaining flaps is further constructed and arranged to engage the container so as to resist rotation with respect to the container, whereby separation of said tamper evident band from the body portion is assured when the closure is unscrewed from the container.

A tamper evident closure according to a third aspect of the invention includes a body portion comprising a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the connector elements have a first maximum thickness and the retaining flaps have a second maximum thickness, and wherein the first maximum thickness is within a range of about 10 percent to about 60 percent of the second maximum thickness; and wherein each of the retaining flaps has an upper portion that is constructed and arranged to engage retention structure of a container in order to prevent upward movement of the tamper evident band with respect to the container, and wherein at least one of the retaining flaps is further constructed and arranged to engage the container so as to resist rotation with respect to the container, whereby separation of the tamper evident band from the body portion is assured when the closure is unscrewed from the container.

A tamper evident closure according to a fourth aspect of the invention includes a body portion comprising a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the connector elements have a first maximum cross-sectional area taken in a vertical plane and wherein the retaining flaps have a second maximum cross-sectional area taken in a vertical plane, and wherein the first maximum cross-sectional area is within a range of about 20 percent to about 50 percent of the second maximum cross-sectional area; and wherein each of the retaining flaps has an upper portion that is constructed and arranged to engage retention structure of a container in order to prevent upward movement of the tamper evident band with respect to the container, and wherein at least one of the retaining flaps is further constructed and arranged to engage the container so as to resist rotation with respect to the container, whereby separation of the tamper evident band from the body portion is assured when the closure is unscrewed from the container.

A tamper evident closure according to a fifth aspect of the invention includes a body portion comprising a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the retaining flaps comprise a longitudinally extending body column portion for optimizing a column strength of the retaining flaps; and wherein each of the retaining flaps has an upper portion that is constructed and arranged to engage retention structure of a container in order to prevent upward movement of the tamper evident band with respect to the container, and wherein at least one of the retaining flaps is further constructed and arranged to engage the container so as to resist rotation with respect to the container, whereby separation of the tamper evident band from the body portion is assured when the closure is unscrewed from the container.

A tamper evident closure according to his sixth aspect of the invention includes a body portion comprising a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the main band portion is constructed and arranged to define a radial gap between an interior wall of said main band portion and an exterior surface of ratchet structure on the container after application of the closure to the container, said radial gap being a first radial distance, and wherein said retaining flaps have a maximum thickness that is within a range of about 60 percent to about 95 percent of said first radial distance; and wherein each of the retaining flaps has an upper portion that is constructed and arranged to engage retention structure of a container in order to prevent upward movement of the tamper evident band with respect to the container, and wherein at least one of the retaining flaps is further constructed and arranged to engage the container so as to resist rotation with respect to the container, whereby separation of the tamper evident band from the body portion is assured when the closure is unscrewed from the container.

A container assembly according to his seventh aspect of the invention includes a container having a main body portion and a finish portion, the finish portion comprising at least one external thread that is constructed and arranged to facilitate attachment of a closure to the container, radially extending retention structure positioned beneath the external thread, the radially extending retention structure comprising an annular ring that is unitary with the finish portion, the annular ring protruding radially outwardly from the finish portion by a first distance, and rotational locking structure that is integral with an underside of the annular ring for arresting rotation of a tamper evident band on a closure relative to the container in at least one direction, and wherein the rotational locking structure extends radially outwardly by a second distance that is no greater than the first distance; and a tamper-evident closure comprising a body portion having a base and an internally threaded downwardly depending sidewall portion; and a tamper evident band frangibly connected to the sidewall portion, the tamper evident band including a main band portion, and a J-hook retention member that includes a plurality of retaining flaps and a plurality of connector elements, each of the connector elements being unitary at a first end with a first retaining flap and at a second end with a second retaining flap, whereby the connector elements and the retaining flaps extend in a continuous closed hoop-like structure, and wherein the main band portion is constructed and arranged to define a radial gap between an interior wall of the main band portion and a radially outermost surface of the rotational locking structure after application of the closure to the container, the radial gap being a first radial distance, and wherein the retaining flaps have a maximum thickness that is within a range of about 60 percent to about 95 percent of the first radial distance; and wherein each of the retaining flaps has an upper portion that is constructed and arranged to engage the annular ring in order to prevent upward movement of the tamper evident band with respect to the container, and wherein at least one of the retaining flaps is further constructed and arranged to engage the rotational locking structure so as to resist rotation with respect to the container, whereby separation of the tamper evident band from the body portion is assured when the closure is unscrewed from the container.

A tamper evident closure according to an eight aspect of the invention includes a body portion having a base; and a downwardly depending sidewall portion, the downwardly depending sidewall portion having a plurality of threads defined on an inner surface thereof, the threads having a multi-lead configuration, and wherein the inner surface further has at least one speed bump defined thereon for frictionally engaging external threading of a container during removal of the closure from the container; and a tamper evident band frangibly connected to the sidewall portion, the tamper evident band including a main band portion, and a J-hook retention member that includes a plurality of retaining flaps.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
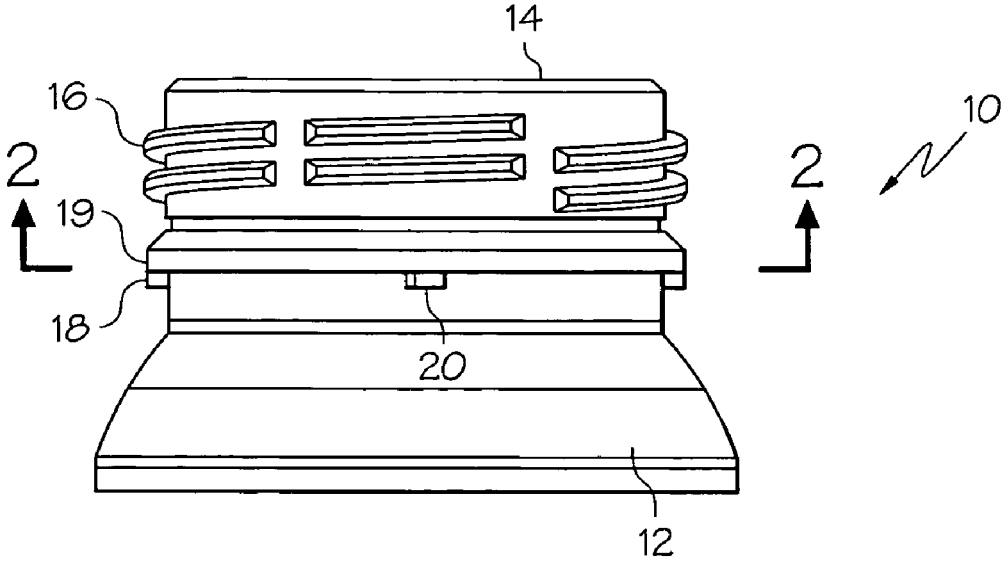
FIG. 1 is a fragmentary side elevational view of a container that is constructed according to a preferred embodiment of the invention.

Referring now to the drawings, wherein like reference numerals designate corresponding structure throughout the views, and referring in particular to FIG. 1, a container assembly 10 that is constructed according to the preferred embodiment of the invention includes a container 12 having a finish portion 14 that is molded with external threads 16. As is conventional, finish portion 14 is provided with retention structure 18 for retaining a tamper evident band by limiting upward movement of the tamper evident band after a closure has been applied to the finish portion 14 of the container assembly 10. In the illustrated embodiment, retention structure 18 is a radially outwardly projecting continuous annular ring 19.

Figure 2:
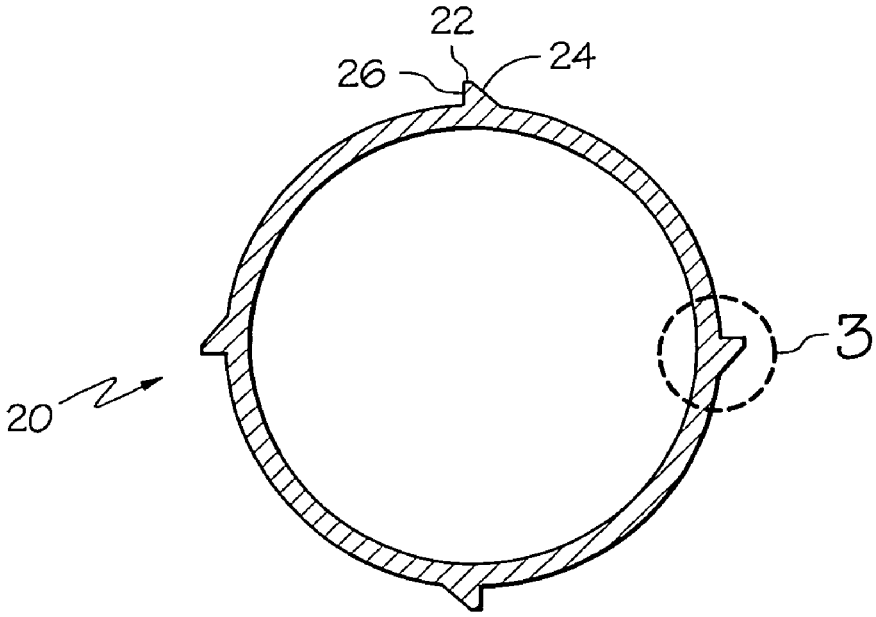
FIG. 2 is a cross-sectional view taken along lines 2-2 in FIG. 1.
Figure 3:
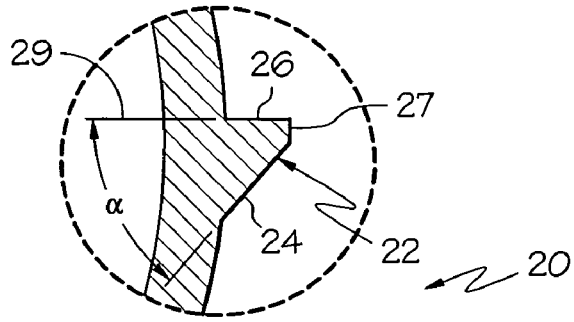
FIG. 3 is a magnified view of an area in FIGURE to that is indicated by lines 3-3 in FIG. 2.

As may further be seen in FIG. 1, container 12 further includes rotational locking structure that is constructed and arranged so as to arrest rotation of the tamper evident band with respect to the container 12, as will be described in appropriate detail below. Referring now to FIGS. 2 and 3, it will be seen that the rotational locking structure 20 is preferably embodied as four ratchet teeth 22, which are spaced about the circumference of the lower part of the finish portion 14, beneath the retention structure 18, at 90 degree intervals. As may best be seen in FIG. 3, each ratchet tooth 22 includes a ramped leading edge 24, which is angled with respect to a radius 29 of the finish portion 14 at an angle $\alpha$ so as to guide a tamper evident band such as the tamper evident band 38 described herein thereover during the initial application of a closure to the finish portion 14 of the container assembly 10. Each ratchet tooth 22 further includes a flat trailing edge 26 that is preferably flat and terminates in an edge 27 so as to arrest movement of the tamper evident band 38 in an unscrewing direction after the closure has been applied to the finish portion. As may be seen in FIG. 3, flat trailing edge 26 is preferably positioned within a radial plane 29 of the finish portion 14.

Preferably, the rotational locking structure is positioned so as to be at least substantially adjacent to the retention structure 18. At least substantially adjacent is defined as being positioned within a distance of no more than about 0.25 inches from the retention structure 18. In the more preferred embodiment, the rotational locking structure is preferably molded so as to be unitary with a lower surface of the radially outwardly projecting continuous annular ring 19.

Figure 4:
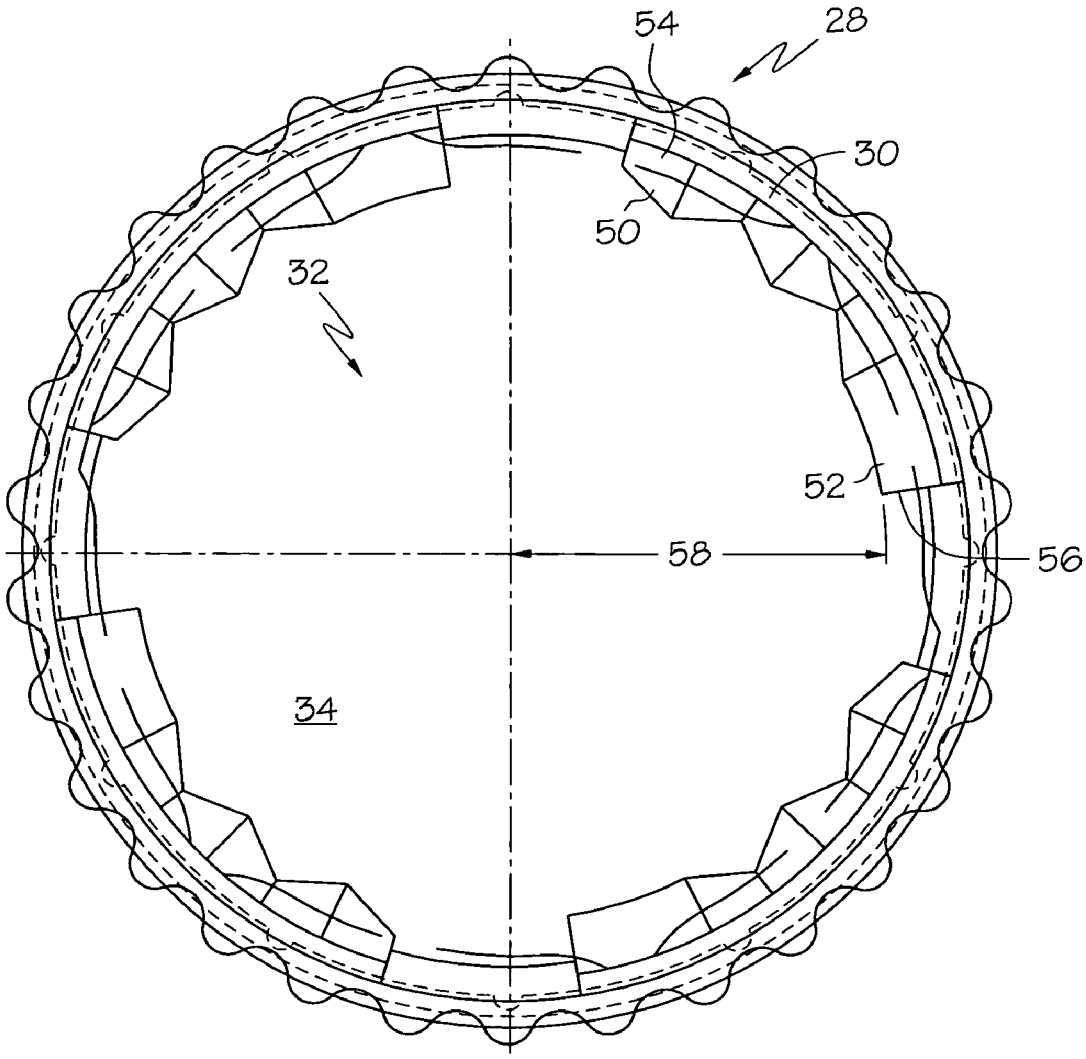
FIG. 4 is a bottom plan view of a closure according to the preferred embodiment of the invention.
Figure 5:
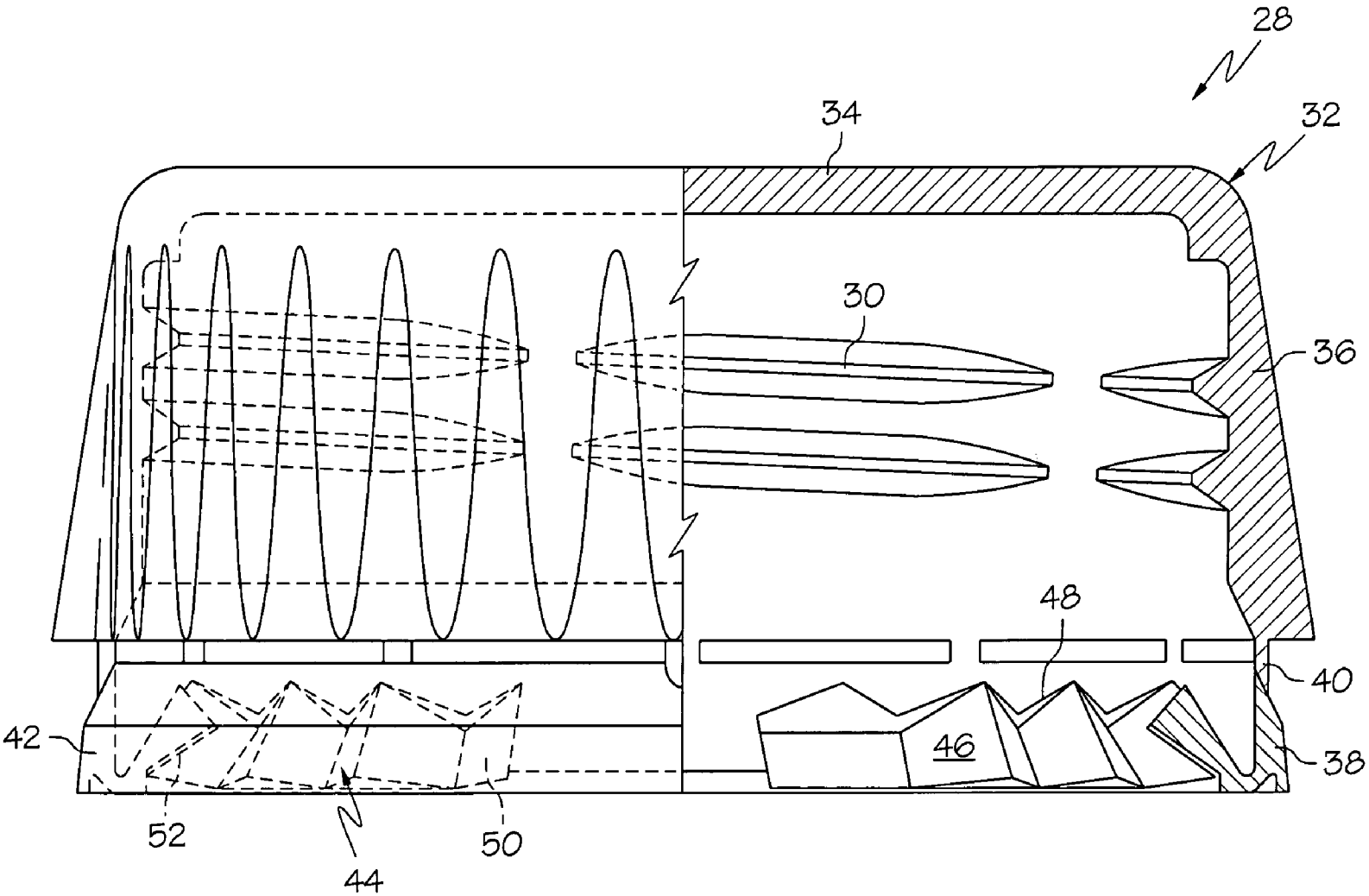
FIG. 5 is a partially diagrammatical, partially cross-sectional view depicting features of the closure that is depicted in FIG. 4

Referring now to FIGS. 4 and 5, it will be seen that container assembly 10 further includes a closure 28 having a body portion 32 with a base 34 and a downwardly depending annular sidewall portion 36 that has internal threading 30 defined thereon. Closure 28 further includes a tamper evident band 38 that is frangibly connected to the sidewall portion 36 by a plurality of breakable bridges 40, as is well known in this area of technology. Tamper evident band 38 includes, as is best shown in FIG. 5, a main band portion 42 and a J-hook retention member 44 that includes a plurality of pleated retaining flaps 46. Each of the pleated retaining flaps 46 has an upper portion 48 that is constructed and arranged to engage the retention structure 18 of the container 12 in order to prevent upward movement of the tamper evident band 38 with respect to the container 12 after the closure 28 has been applied to the container 12.

According to one important aspect of the invention, at least one of the pleated retaining flaps 46 is further constructed and arranged to engage the container 12 so as to resist rotation with respect to the container 12. Accordingly, separation of the tamper evident band 38 from the body portion 32 is better assured when the closure 28 is unscrewed from the container 12. More specifically, in the preferred embodiment there are four of the retaining flaps 46, and each is configured so as to have a leading edge 50, best shown in FIG. 4, that is shaped so as to permit the retaining flaps 46 to pass over the rotational locking structure 20 on the container 12 when the closure 28 is first applied to the container 12. As may be seen in FIG. 4, each of the leading edge is 50 include a ramped surface 54 that are ramped radially inwardly in a direction corresponding to an application motion of the closure 28 onto the container 12. Conversely, each of the retaining flaps 46 also includes a trailing edge 52 that is shaped so as to firmly engage the rotational locking structure 20 when the closure 28 is being unscrewed from the container 12. As may be seen in FIG. 4, trailing edge 52 is positioned radially inwardly from the leading edge 50, and is characterized by a flat abutment surface 56 that is oriented so as to be within a radial plane 58 of the closure 28. Abutment surface 56 will, upon any attempt to unscrew the closure 28 from the container 12, firmly engage against the flat trailing surface 26 of the rotational locking structure 20, thereby ensuring rupture of the bridges 40 and separation of the tamper evident band 38 from the main body portion 32 of the closure 28 before any significant rotational displacement occurs between the closure 28 and the container 12.

A tamper evident closure 110 that is constructed according to a second embodiment of the invention is depicted in FIGS. 6-10. Closure 110 includes a body portion 112 having a base 114 and an internally threaded downwardly depending sidewall portion 116. An interior surface of sidewall 116 is provided with a plurality of inwardly extending threads 118 that in the preferred embodiment is a double threaded arrangement. A plurality of inwardly extending vent grooves 120 are defined in the inner surface of sidewall 116 in venting areas that are defined by separations between the threads 118. At least one speed bump 122 is also defined in sidewall 116 for frictionally engaging the external threads on the finish portion of the container during removal of the closure 110 from the container in order to prevent uncontrolled separation of the closure from the container when the contents of the container are under pressurization. In the preferred embodiment, speed bump 122 is tapered at an angle that is between about two degrees to about five degrees and extends radially inwardly at its lower end by a distance that is within a range of about 0.010 inches to about 0.030 inches.

Closure 110, as may be seen in the drawings, is a multi-lead closure, specifically having two leads, which are constructed and arranged to mate with a corresponding pair of threads 16 that are arranged in a two lead threading on the finish portion 14 of the container 10. The combination of the speed bump 122 in the environment of a multi-lead closure provides important advantages and that it slows the opening of the closure 110 when the closure 110 is being removed from the finish portion 14 of the container 10.

Closure 110 further includes a tamper evident band 124 that is frangibly connected to the sidewall 116 and that includes a main band portion 126 and a J-hook retention member 128 that is defined by a plurality of retaining flaps 130 and a corresponding plurality of connector elements 132. Each of the connector elements 132 is unitary at a first end with a first retaining flaps 130 and that a second end with a second retaining flap 130 so that the connector elements 132 and the retaining flaps 130 together define a continuous closed hoop like structure 134. This continuous closed hoop like structure 134 imparts a hoop strength to the J-hook retention member that creates enhanced resistance to radially outward movement during engagement of the tamper evident band 124 with the finish portion of the container, as will be described in greater detail below.

Figure 6:
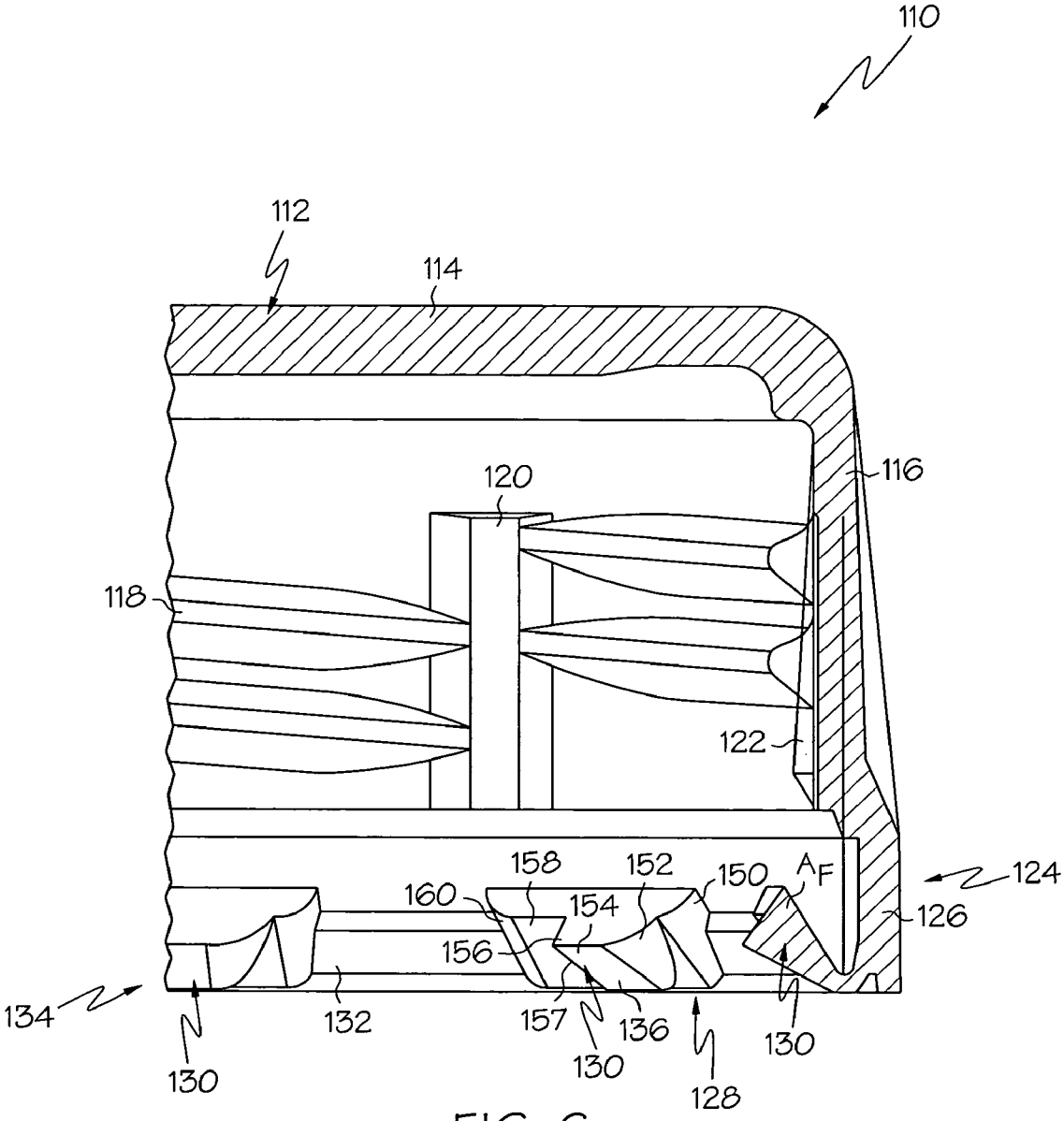
FIG. 6 is a fragmentary cross-sectional view of a closure that is constructed according to a second embodiment of the invention.

As may be seen in FIG. 6 each of the retaining flaps 130 is preferably configured so that it has a longitudinally extending body column 136 for optimizing a column strength of the retaining flaps 130.

Figure 8:
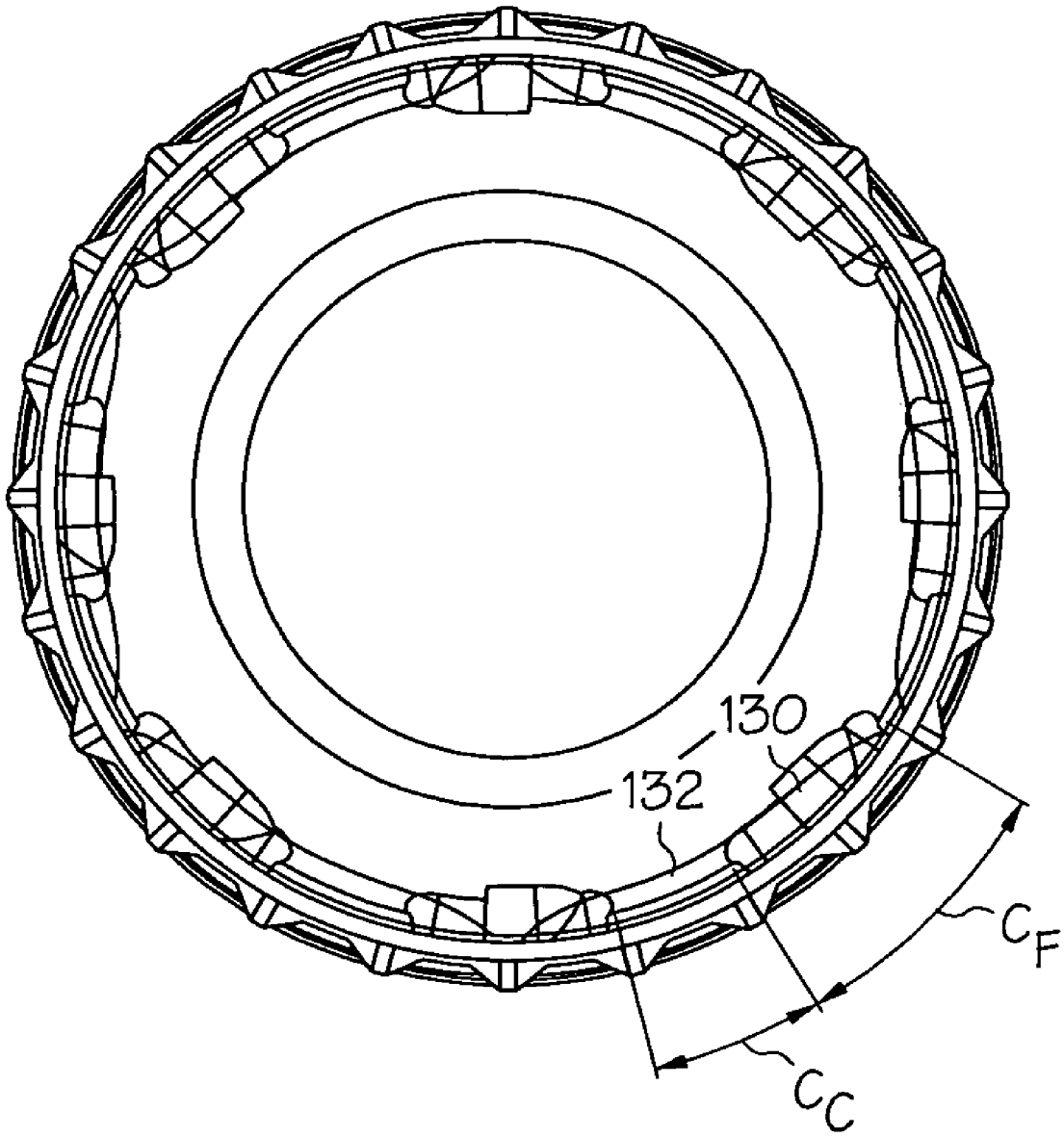
FIG. 8 is a bottom plan view of the closure that is depicted in FIG. 6.

Referring briefly to FIG. 8, it will be seen that each of the retaining flaps 130 extends for a circumferential distance $C_F$, while each connector element 132 extends for a circumferential distance $C_C$. In this embodiment of the invention, there are eight retaining flaps 130 and eight connector elements 132. According to one advantageous aspect of the invention, the total circumferential distance that is occupied by the retaining flaps 130 is within a range of about 40 percent to about 85 percent of a total circumference of the hoop like structure 134. More preferably, this total circumferential distance occupied by the retaining flaps 130 is within a range of about 50 percent to about 70 percent of the total circumference of the hoop like structure.

Figure 7:
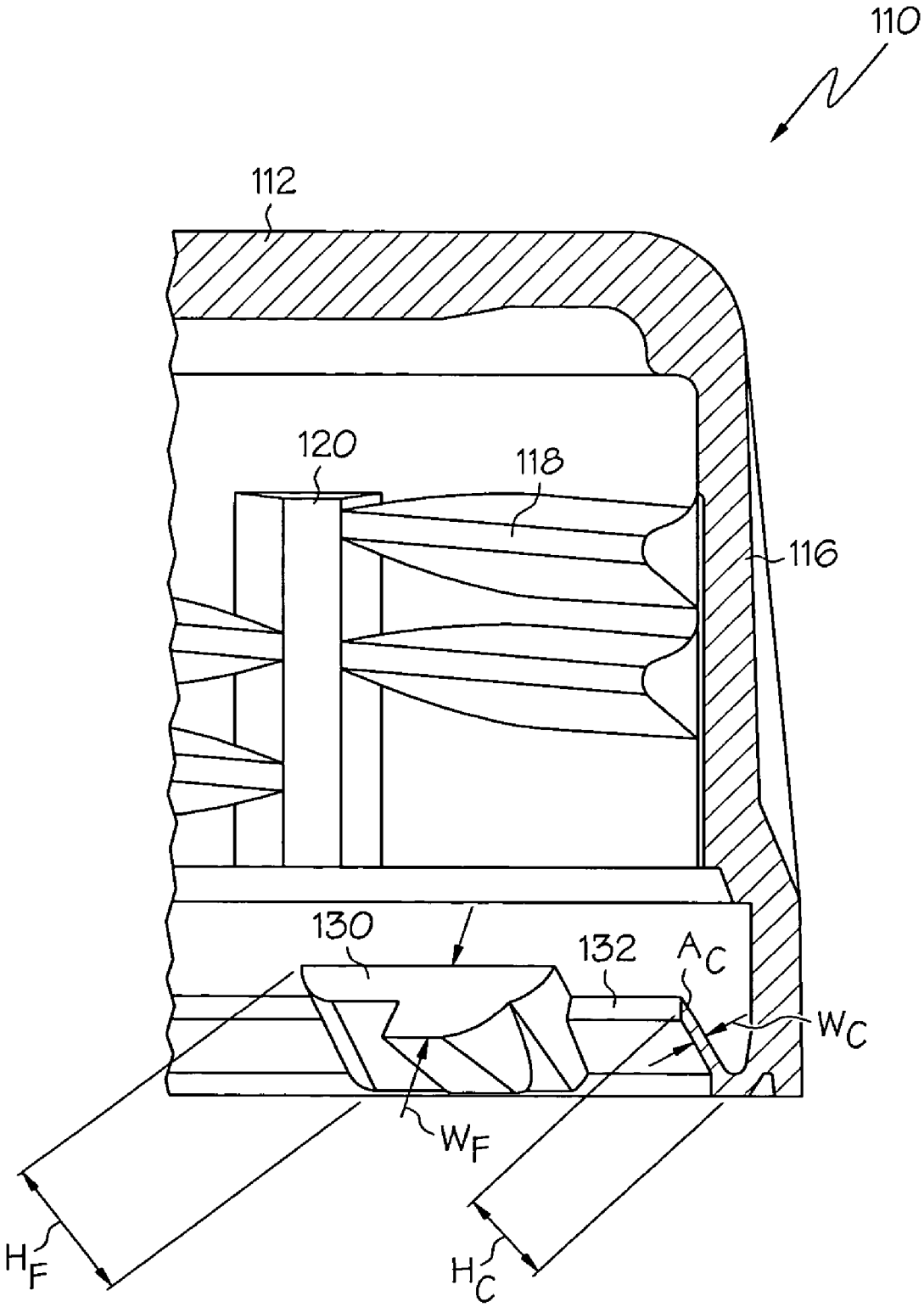
FIG. 7 is another fragmentary cross-sectional view of the closure that is depicted in FIG. 6.

As is shown in FIG. 7, each of the connector elements 132 has a maximum height $H_C$, while each of the retaining flaps 130 has a corresponding maximum height $H_F$. According to another advantageous aspect of the invention, the maximum height $H_C$ of the connector elements 132 is within a range of about 50 percent to about 95 percent of the maximum height $H_F$ of the retaining flaps 130, and more preferably within a range of about 65 percent to about 85 percent of the maximum height $H_F$ of the retaining flaps 130.

FIG. 7 further depicts the connector element as having a maximum width $W_C$, and the retaining flap as having a corresponding maximum width $W_F$. According to another advantageous aspect of the invention, the maximum width or thickness $W_C$ of the connector elements is preferably within a range of about 10 percent to about 60 percent of the maximum width or thickness $W_F$ of the retaining flaps, and more preferably within a range of about 10 percent to about 30 percent of the maximum width or thickness $W_F$ of the retaining flaps.

FIG. 7 further illustrates a first maximum cross-sectional area $A_C$ taken in a vertical plane through one of the connector elements 132. FIG. 6 illustrates a maximum cross-sectional area $A_F$ of one of the retaining flaps 130 also taken in a vertical plane. According to another advantageous aspect of the invention, the maximum such cross-sectional area $A_C$ of the connector elements 132 is within a range of about 20 percent to about 50 percent of the maximum such cross-sectional area $A_F$ of the retaining flaps 130. More preferably, the maximum cross-sectional area $A_C$ of the connector elements 132 is within a range of about 25 percent to about 40 percent of the maximum cross-sectional area $A_F$ of the retaining flaps 130.

Figure 9:
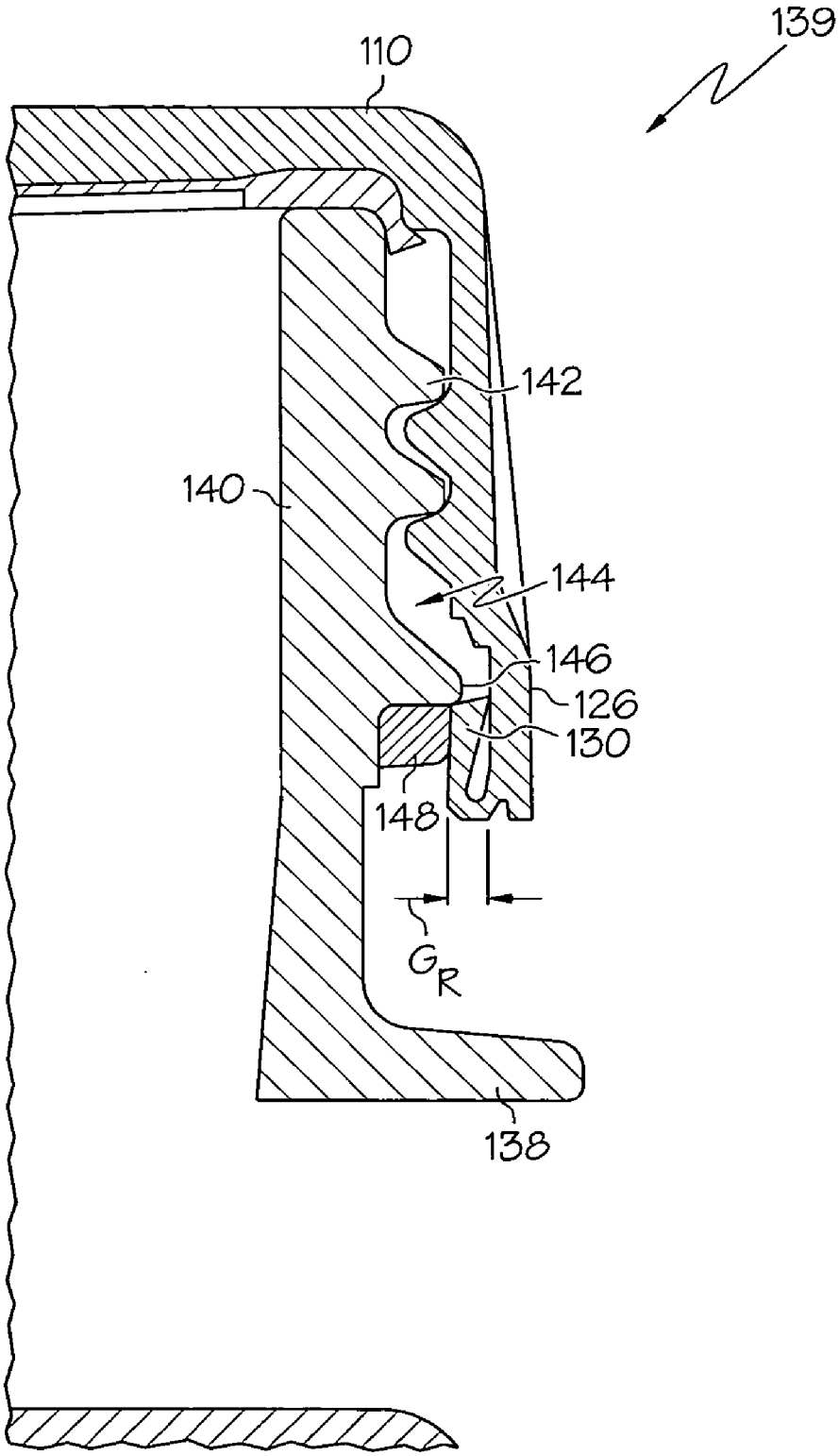
FIG. 9 is a cross-sectional view depicting a container assembly according to the second embodiment of the invention.

FIG. 9 illustrates a container assembly 139 according to the second embodiment of the invention in which the closure 110 is shown fitted upon a container 138 that has an upstanding finish portion 140 with a plurality of external threads 142 and a radially extending retention structure 144. In the preferred embodiment, the radially extending retention structure 144 is embodied as an annular ring 146 that projects outwardly by a first radial distance. Rotational locking structure 148, which in the preferred embodiment is formed by four evenly circumferentially spaced locking ratchets that are unitary with the underside of the annular ring 146 is further shown in FIG. 9. The rotational locking structure 148 extends outwardly by a second distance that is preferably no greater than the first radial distance to which the annular ring 146 extends.

A radial gap $G_R$ is defined between an interior wall of the main band portion 126 of the tamper evident band 124 and the radially outermost extent of the rotational locking structure 148. According to another advantageous aspect of the invention, the maximum thickness $W_F$ of the retaining flaps is preferably within a range of about 60 percent to about 95 percent, and more preferably within a range of about 75 percent to about 90 percent of the radial gap $G_R$.

Referring again to FIG. 6, it will be seen that the retaining flap 130 is preferably shaped so as to include a first convexly radius ramp portion 150, a second convexly radiused ramp portion 152 and a flat surface 154 that represents the radially innermost surface of the retaining flap 130. A flat ratchet surface 156 extends within a plane that is substantially parallel to a radius of the closure 110 and that is substantially perpendicular to the flat surface 136. A ratchet edge 157 is defined between the flat surface 154 and the flat ratchet surface 156. Flat ratchet surface 156 is constructed and arranged to engage with a corresponding radially extending flat surface on the rotational locking structure 148 to prevent rotation of the tamper evident band 124 relative to the container during opening. Retaining flap 130 further includes a flat tail surface 158 and a convexly radiused tail surface 160 that provides a transition between the flat tail surface 158 and the adjacent connector element 132.

Figure 10:
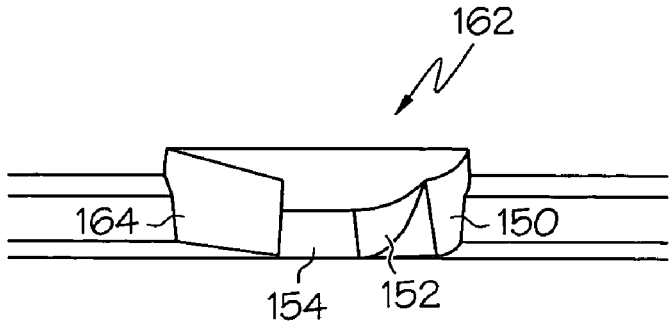
FIG. 10 is a fragmentary side elevational view of a portion of a closure that is constructed according to a third alternative embodiment of the invention.

Referring now to FIG. 10, a retaining flap 162 that is constructed according to a third embodiment of the invention will now be described. Retaining flap 162 is characterized by a tapered wedge surface 164 that has been substituted for the flat tail surface 158 and the convexly radiused tail surface 160 that is described above with reference to the embodiment of FIG. 6. The presence of the tapered wedge surface 164 would improve functionality of the retaining flap 162 in the sense that it would improve the ability to position the rotational locking structure 148 in the correct orientation to the ratchet edge 157 and provide assured tamper evidence.

Figure 11:
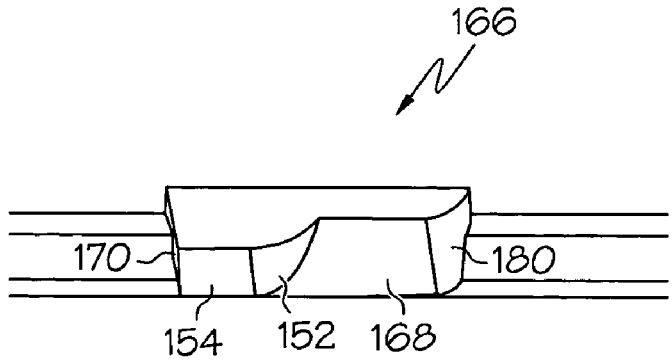
FIG. 11 is a fragmentary side elevational view of a portion of a closure that is constructed according to a fourth alternative embodiment of the invention.

FIG. 11 illustrates a retaining flap 166 that is constructed according to a fourth embodiment of the invention. In this embodiment, an elongated forward flat portion 168 is provided forwardly of the convexly radiused ramp portion 152 and the radially outermost flat portion 154. A radially extending ratchet surface 170 intersecting the rearward most and of the flat portion 154 extends directly to the adjacent connector element 132. This orientation of the ratchet edge 170 at the edge of the flap 166 provides a larger surface to mate with the rotational locking structure 148, which will provide a more positive locking of the tamper evident band to the bottled finish and assured tamper evidence.

Figure 12:
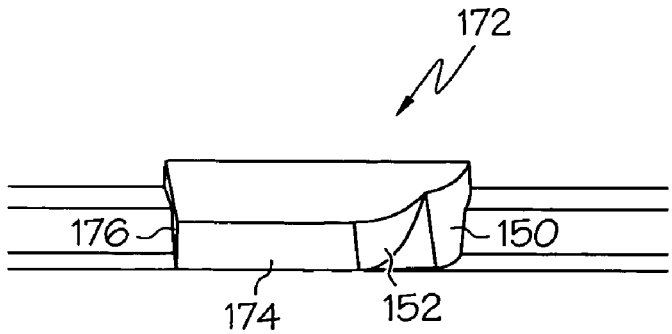
FIG. 12 is a fragmentary side elevational view of a portion of a closure that is constructed according to a fifth alternative embodiment of the invention.

FIG. 12 illustrates a retaining flap 172 that is constructed according to a fifth embodiment of the invention. In this embodiment, a radially outermost flat portion 174 is provided leading to a radially extending ratchet surface 176 that extends directly to the adjacent connector element 132. This design has the advantages of that shown in FIG. 11, with the benefit that the larger outermost flat portion 174 is larger and provides improved resistance to buckling, which will improve the resistance of the flat to being rotated over the rotational locking structure 148.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tamper evident closure, comprising:

a body portion comprising a base and an internally threaded downwardly depending sidewall portion; and a tamper evident band frangibly connected to said sidewall portion, said tamper evident band comprising:

a main band portion, and a J-hook retention member that includes a plurality of retaining flaps and a plurality of connector elements extending only between said retaining flaps, each of said connector elements being unitary at a first end with a first retaining flap and at a second end with a second retaining flap, whereby said connector elements and said retaining flaps extend in a continuous closed hoop-like structure, and wherein said connector elements have a first maximum height and said retaining flaps have a second maximum height, and wherein said first height is within a range of about 50 percent to about 95 percent of said second height;

and wherein each of said retaining flaps has an upper portion that is constructed and arranged to engage retention structure of a container in order to prevent upward movement of said tamper evident band with respect to the container, and wherein at least one of the retaining flaps is further constructed and arranged to engage the container so as to resist rotation with respect to the container, whereby separation of said tamper evident band from said body portion is assured when the closure is unscrewed from the container, and wherein each of said retaining flaps is shaped as to include a first convexly radius ramp portion, a second convexly radiused ramp portion and a flat forward portion, which is provided between the first and the second convexly radiused ramp portion.

2. A tamper evident closure according to claim 1, wherein said first maximum height is within a range of about 65 percent to about 85 percent of said second maximum height.

3. A tamper evident closure according to claim 1, wherein said connector elements have a first maximum thickness and said retaining flaps have a second maximum thickness, and wherein said first maximum thickness is within a range of about 10 percent to about 60 percent of said second maximum thickness.

4. A tamper evident closure according to claim 3, wherein said first maximum thickness is within a range of about 10 percent to about 30 percent of said second maximum thickness.

5. A tamper evident closure according to claim 1, wherein said connector elements have a first maximum cross-sectional area taken in a vertical plane and wherein said retaining flaps have a second maximum cross-sectional area taken in a vertical plane, and wherein said first maximum cross-sectional area is within a range of about 20 percent to about 50 percent of said second maximum cross-sectional area.

6. A tamper evident closure according to claim 5, wherein said first maximum cross-sectional area is within a range of about 25 percent to about 40 percent of said second maximum cross-sectional area.

7. A tamper evident closure according to claim 1, wherein said retaining flaps comprise a longitudinally extending body column portion for optimizing a column strength of said retaining flaps.

8. A tamper evident closure according to claim 1, wherein said main band portion is constructed and arranged to define a radial gap between an interior wall of said main band portion and an exterior surface of ratchet structure on the container after application of said closure to the container, said radial gap being a first radial distance, and wherein said retaining flaps have a maximum thickness that is within a range of about 60 percent to about 95 percent of said first radial distance.

9. A tamper evident closure according to claim 8, wherein said retaining flaps have a maximum thickness that is within a range of about 75 percent to about 90 percent of said first radial distance.

10. A tamper evident closure according to claim 1, wherein said retaining flaps together extend for an aggregate flap circumferential distance about said hoop-like structure that is within a range of about 40 percent to about 85 percent of a total circumference of said hoop-like structure.

11. A tamper evident closure, comprising:

a body portion comprising a base and an internally threaded downwardly depending sidewall portion; and a tamper evident band frangibly connected to said sidewall portion, said tamper evident band comprising:

a main band portion, and a J-hook retention member that includes a plurality of retaining flaps and a plurality of connector elements extending only between said retaining flaps, each of said connector elements being unitary at a first end with a first retaining flap and at a second end with a second retaining flap, whereby said connector elements and said retaining flaps extend in a continuous closed hoop-like structure, and wherein said connector elements have a first maximum thickness and said retaining flaps have a second maximum thickness, and wherein said first maximum thickness is within a range of about 10 percent to about 60 percent of said second maximum thickness;

and wherein each of said retaining flaps has an upper portion that is constructed and arranged to engage retention structure of a container in order to prevent upward movement of said tamper evident band with respect to the container, and wherein at least one of the retaining flaps is further constructed and arranged to engage the container so as to resist rotation with respect to the container, whereby separation of said tamper evident band from said body portion is assured when the closure is unscrewed from the container and wherein each of said retaining flaps is shaped as to include a first convexly radius ramp portion, a second convexly radiused ramp portion and a flat forward portion, which is provided between the first and the second convexly radiused ramp portion.

12. A tamper evident closure according to claim 11, wherein said first maximum thickness is within a range of about 10 percent to about 30 percent of said second maximum thickness.

13. A tamper evident closure according to claim 11, wherein said connector elements have a first maximum cross-sectional area taken in a vertical plane and wherein said retaining flaps have a second maximum cross-sectional area taken in a vertical plane, and wherein said first maximum cross-sectional area is within a range of about 20 percent to about 50 percent of said second maximum cross-sectional area.

14. A tamper evident closure according to claim 13, wherein said first maximum cross-sectional area is within a range of about 25 percent to about 40 percent of said second maximum cross-sectional area.

15. A tamper evident closure according to claim 11, wherein said retaining flaps comprise a longitudinally extending body column portion for optimizing a column strength of said retaining flaps.

16. A tamper evident closure according to claim 11, wherein said main band portion is constructed and arranged to define a radial gap between an interior wail of said main band portion and an exterior surface of ratchet structure on the container after application of said closure to the container, said radial gap being a first radial distance, and wherein said retaining flaps have a maximum thickness that is within a range of about 60 percent to about 95 percent of said first radial distance.

17. A tamper evident closure according to claim 16, wherein said retaining flaps have a maximum thickness that is within a range of about 75 percent to about 90 percent of said first radial distance.

18. A tamper evident closure according to claim 11, wherein said retaining flaps together extend for an aggregate flap circumferential distance about said hoop-like structure that is within a range of about 40 percent to about 85 percent of a total circumference of said hoop-like structure.

19. A tamper evident closure, comprising: a body portion comprising a base and an internally threaded downwardly depending sidewall portion; and a tamper evident band frangibly connected to said sidewall portion, said tamper evident band comprising:

a main band portion, and a J-hook retention member that includes a plurality of retaining flaps and a plurality of connector elements extending only between said retaining flaps, each of said connector elements being unitary at a first end with a first retaining flap and at a second end with a second retaining flap, whereby said connector elements and said retaining flaps extend in a continuous closed hoop-like structure, and wherein said connector elements have a first maximum cross-sectional area taken in a vertical plane and wherein said retaining flaps have a second maximum cross sectional area taken in a vertical plane, and wherein said first maximum cross-sectional area is within a range of about 20 percent to about 50 percent of said second maximum cross-sectional area; and wherein each of said retaining flaps has an upper portion that is constructed and arranged to engage retention structure of a container in order to prevent upward movement of said tamper evident band with respect to the container; and wherein at least one of the retaining flaps is further constructed and arranged to engage the container so as to resist rotation with respect to the container, whereby separation of said tamper evident band from said body portion is assured when the closure is unscrewed from the container and wherein each of said retaining flaps is shaped as to include a first convexly radius ramp portion, a second convexly radiused ramp portion and a flat forward portion, which is provided between the first and the second convexly radiused ramp portion.

20. A tamper evident closure according to claim 19, wherein said first maximum cross-sectional area is within a range of about 25 percent to about 40 percent of said second maximum cross-sectional area.

21. A tamper evident closure according to claim 19, wherein said retaining flaps comprise a longitudinally extending body column portion for optimizing a column strength of said retaining flaps.

22. A tamper evident closure according to claim 19, wherein said main band portion is constructed and arranged to define a radial gap between an interior wall of said main band portion and an exterior surface of ratchet structure on the container after application of said closure to the container, said radial gap being a first radial distance, and wherein said retaining flaps have a maximum thickness that is within a range of about 60 percent to about 95 percent of said first radial distance.

23. A tamper evident closure according to claim 22, wherein said retaining flaps have a maximum thickness that is within a range of about 75 percent to about 90 percent of said first radial distance.

24. A tamper evident closure according to claim 19, wherein said retaining flaps together extend for an aggregate flap circumferential distance about said hoop-like structure that is within a range of about 40 percent to about 85 percent of a total circumference of said hoop-like structure.

25. A tamper evident closure, comprising: a body portion comprising a base and an internally threaded downwardly depending sidewall portion; and a tamper evident band frangibly connected to said sidewall portion, said tamper evident band comprising:

a main band portion, and a J-hook retention member that includes a plurality of retaining flaps and a plurality of connector elements extending only between said retaining flaps, each of said connector elements being unitary at a first end with a first retaining flap and at a second end with a second retaining flap, whereby said connector elements and said retaining flaps extend in a continuous closed hoop-like structure, and wherein said retaining flaps comprise a longitudinally extending body column portion for optimizing a column strength of said retaining flaps; and wherein each of said retaining flaps has an upper portion that is constructed and arranged to engage retention structure of a container in order to prevent upward movement of said tamper evident band with respect to the container, and wherein at least one of the retaining flaps is further constructed and arranged to engage the container so as to resist rotation with respect to the container, whereby separation of said tamper evident band from said body portion is assured when the closure is unscrewed from the container and wherein each of said retaining flaps is shaped as to include a first convexly radius ramp portion, a second convexly radiused ramp portion and a flat forward portion, which is provided between the first and the second convexly radiused ramp portion.

26. A tamper evident closure according to claim 25, wherein said main band portion is constructed and arranged to define a radial gap between an interior wall of said main band portion and an exterior surface of ratchet structure on the container after application of said closure to the container, said radial gap being a first radial distance, and wherein said retaining flaps have a maximum thickness that is within a range of about 60 percent to about 95 percent of said first radial distance.

27. A tamper evident closure according to claim 26, wherein said retaining flaps have a maximum thickness that is within a range of about 75 percent to about 90 percent of said first radial distance.

28. A tamper evident closure according to claim 25, wherein said retaining flaps together extend for an aggregate flap circumferential distance about said hoop-like structure that is within a range of about 40 percent to about 85 percent of a total circumference of said hoop-like structure.

29. A tamper evident closure, comprising:

a body portion comprising a base and an internally threaded downwardly depending sidewall portion; and a tamper evident band frangibly connected to said sidewall portion, said tamper evident band comprising:

a main band portion, and a J-hook retention member that includes a plurality of retaining flaps and a plurality of connector elements extending only between said retaining flaps, each of said connector elements being unitary at a first end with a first retaining flap and at a second end with a second retaining flap, whereby said connector elements and said retaining flaps extend in a continuous closed hoop-like structure, and wherein said main band portion is constructed and arranged to define a radial gap between an interior wall of said main band portion and an exterior surface of ratchet structure on the container after application of said closure to the container, said radial gap being a first radial distance, and wherein said retaining flaps have a maximum thickness that is within a range of about 60 percent to about 95 percent of said first radial distance; and wherein each of said retaining flaps has an upper portion that is constructed and arranged to engage retention structure of a container in order to prevent upward movement of said tamper evident band with respect to the container, and wherein at least one of the retaining flaps is further constructed and arranged to engage the container so as to resist rotation with respect to the container, whereby separation of said tamper evident band from said body portion is assured when the closure is unscrewed from the container and wherein each of said retaining flaps is shaped as to include a first convexly radius ramp portion, a second convexly radiused ramp portion and a flat forward portion, which is provided between the first and the second convexly radiused ramp portion.

30. A tamper evident closure according to claim 29, wherein said retaining flaps have a maximum thickness that is within a range of about 75 percent to about 90 percent of said first radial distance.

31. A tamper evident closure according to claim 29, wherein said retaining flaps together extend for an aggregate flap circumferential distance about said hoop-like structure that is within a range of about 40 percent to about 85 percent of a total circumference of said hoop-like structure.

32. A container assembly, comprising:

a container having a main body portion and a finish portion, said finish portion comprising at least one external thread that is constructed and arranged to facilitate attachment of a closure to said container, radially extending retention structure positioned beneath said external thread, said radially extending retention structure comprising an annular ring that is unitary with said finish portion, said annular ring protruding radially outwardly from said finish portion by a first distance, and rotational locking structure that is integral with an underside of said annular ring for arresting rotation of a tamper evident band on a closure relative to said container in at least one direction, and wherein said rotational locking structure extends radially outwardly by a second distance that is no greater than said first distance; and a tamper-evident closure comprising a body portion having a base and an internally threaded downwardly depending sidewall portion; and a tamper evident band frangibly connected to said sidewall portion, said tamper evident band comprising:

a main band portion, and a J-hook retention member that includes a plurality of retaining flaps and a plurality of connector elements extending only between said retaining flaps, each of said connector elements being unitary at a first end with a first retaining flap and at a second end with a second retaining flap, whereby said connector elements and said retaining flaps extend in a continuous closed hoop-like structure, and wherein said main band portion is constructed and arranged to define a radial gap between an interior wall of said main band portion and a radially outermost surface of said rotational locking structure after application of said closure to the container, said radial gap being a first radial distance, and wherein said retaining flaps have a maximum thickness that is within a range of about 60 percent to about 95 percent of said first radial distance; and wherein each of said retaining flaps has an upper portion that is constructed and arranged to engage said annular ring in order to prevent upward movement of said tamper evident band with respect to the container, and wherein at least one of the retaining flaps is further constructed and arranged to engage the rotational locking structure so as to resist rotation with respect to the container, whereby separation of said tamper evident band from said body portion is assured when the closure is unscrewed from the container and wherein each of said retaining flaps is shaped as to include a first convexly radius ramp portion, a second convexly radiused ramp portion and a flat forward portion, which is provided between the first and the second convexly radiused ramp portion.

33. A container assembly according to claim 32, wherein said retaining flaps have a maximum thickness that is within a range of about 75 percent to about 90 percent of said first radial distance.

34. A tamper evident closure, comprising:

a body portion comprising a base; and a downwardly depending sidewall portion, said downwardly depending sidewall portion having a plurality of threads defined on an inner surface thereof, said threads having a multi-lead configuration, and wherein said inner surface further has at least one speed bump defined thereon for frictionally engaging external threading of a container during removal of said closure from the container; and a tamper evident band frangibly connected to said sidewall portion, said tamper evident band comprising: a main band portion, and a J-hook retention member that includes a plurality of retaining flaps and a plurality of connector elements extending only between said retaining flap, each of said connector elements being unitary at a first end with a first retaining flap and at a second end with a second retaining flap, whereby said connector elements and said retaining flaps extend in a continuous closed hoop-like structure and wherein each of said retaining flaps is shaped as to include a first convexly radius ramp portion, a second convexly radiused ramp portion and a flat forward portion, which is provided between the first and the second convexly radiused ramp portion.

* * * * *

UNITED STATES PATENT AND TRADEMARK OFFICE

CERTIFICATE OF CORRECTION

PATENT NO. : 7,637,384 B2
APPLICATION NO. : 10/957924
DATED : December 29, 2009
INVENTOR(S) : Price et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 725 days.

Signed and Sealed this

Ninth Day of November, 2010

David J. Kappos

David J. Kappos
*Director of the United States Patent and Trademark Office*